United States Patent [19]

Wilkes et al.

[11] 4,219,695

[45] Aug. 26, 1980

[54] NOISE ESTIMATION SYSTEM FOR USE IN SPEECH ANALYSIS

[75] Inventors: Arthur L. Wilkes, Woodland Hills; Fred B. Wade, Ventura; Robert L. Thompson, Thousand Oaks, all of Calif.

[73] Assignee: International Communication Sciences, Woodland Hills, Calif.

[21] Appl. No.: 839,520

[22] Filed: Oct. 5, 1977

Related U.S. Application Data

[62] Division of Ser. No. 593,861, Jul. 7, 1975, Pat. No. 4,058,676.

[51] Int. Cl.[2] ..... G10L 1/00

[52] U.S. Cl. ..... 179/1 P

[58] Field of Search ..... 179/1 SA, 1 SC, 1 P

[56] References Cited

U.S. PATENT DOCUMENTS

| | | | |
|---|---|---|---|
| 4,015,088 | 3/1977 | Dubnowski et al. | 179/1 SC |
| 4,074,069 | 2/1978 | Tokura et al. | 179/1 SC |

*Primary Examiner*—Malcolm A. Morrison
*Assistant Examiner*—E. S. Kemeny
*Attorney, Agent, or Firm*—Fulwider, Patton, Rieber, Lee & Utecht

[57] ABSTRACT

Apparatus, and a related method, for use with a speech analysis system, which derives coefficient parameters by linear prediction and utilizes an intermediate correlation technique that produces a set of auto-correlation coefficients. The apparatus includes an estimate register, circuitry for comparing the contents of the estimate register with a first auto-correlation coefficient and setting the estimate register to the value of the first coefficient if the first coefficient is less than or equal to the estimate register contents, and circuitry for incrementing the contents of the estimate register if the first coefficient is greater than the estimate register contents.

3 Claims, 8 Drawing Figures

NOISE ESTIMATION SYSTEM FOR USE IN SPEECH ANALYSIS

This is a division of application Ser. No. 593,861, filed July 7, 1975, now issued as U.S. Pat. No. 4,058,676.

BACKGROUND OF THE INVENTION

The present invention relates generally to speech analysis and synthesis systems, and, more particularly, to techniques for estimating system noise in a speech analysis system. As will become apparent, one technique for determining whether a speech sound is "voiced" or "unvoiced" is, as described and claimed in the aforementioned parent application, to compare the energy level of the speech sound with a background noise level. Unvoiced sounds involve no vibration of the vocal cords, and are much lower in energy than voiced sounds.

An object of the present invention is to provide a noise estimation system for use in conjunction with the speech analysis system described and claimed in the aforementioned parent application, U.S. Pat. No. 4,058,676. So that the present invention may be clearly understood, the entire speech analysis system will be described by way of background. The analysis system in which the invention operates is of a type designed to function in real time, to combine a plurality of telephone channels into a single telephone channel for transmission, subsequent separation of the channels, and synthesis of the speech from the transmitted data.

In the past, numerous techniques have been devised and proposed for analyzing the human voice and deriving abbreviated speech data for use later with a synthesizing device for generating human voice sounds from the speech data. A description of such techniques both historical and modern, may be found in Flanagan, "SPEECH ANALYSIS, SYNTHESIS AND PERCEPTION" (2nd. edition, New York, 1972, Springer-Verlag).

Typically, modern analysis techniques divide digital speech signals into time segments called "frames" of speech data and the speech is analyzed frame by frame. The time segments are too short to be perceptible to the human auditory system and are analyzed to produce a pitch period parameter representative of the vibratory rate of the vocal cords, or, a parameter which indicates no vibration (voiced/unvoiced decision parameter). A power parameter is also generated indicating the relative intensity of the speech signal. Finally, a plurality of coefficient parameters are generated which are generally representative of the filter coefficients of an electrical analog of the human vocal tract.

These control parameters are used in a subsequent speech synthesizer which also is an electrical analog of the human vocal cords and tract which produced the original speech sounds. The electrical output of the synthesizer is applied to a suitable transducer to produce the audible speech sounds.

Generally, known analysis and synthesis techniques produce intelligible imitations of the human voice, but normally the artificiality is noticable. Thus, speech analysis and synthesis techniques have not been used in telephone systems, for example, where it is desired that the speakers not be aware of the analysis synthesis process taking place. Furthermore, the speech signals were normally produced by relatively hifidelity microphones and the like which permitted the speech analysis to take place on speech signals having the full range of appropriate audio frequencies. Speech signals derived from telephone channels with relatively narrow audio pass bands could not be successfully analyzed due to the lack of basic speech frequencies needed for successful analysis. In addition, the computational time required to analyze speech signals was such that it was difficult to perform the analysis process in "real time" for even a single voice channel. Thus, the analysis synthesis was practically useable only for special transmission mediums with relatively wide band widths. Utilization of the analysis synthesis technique for a single channel telephone line offered no particular advantages except for the fact that the transmitted speech data was difficult to decode without knowing the analysis and synthesis process itself.

Thus, prior to the invention claimed in the aforementioned parent application, there was a need for processing techniques that would permit practical utilization of the analysis process in telephone systems. The present invention contributes to the satisfaction of this need, by providing a noise estimation technique for use in analysis systems of the type described and claimed in the parent application.

SUMMARY OF THE INVENTION

The present invention is best described as a technique for more practically relating system noise to such things as, for example, the voiced/unvoiced decision where a high noise level could result in an unvoiced decision when the speech signal is actually voiced. In the system of the present invention, the average noise is estimated from a consideration of the first autocorrelation coefficient parameters descriptive of the vocal tract. The first autocorrelation coefficient generally represents the average power in the speech signal at any given instant and the estimated noise is never allowed to rise above that signal but when the coefficient periodically rises during voiced speech segments, the estimated noise signal can only rise toward that coefficient at a predetermined rate. Thus, the estimated noise signal tends to follow the lowest values of the first auto-correlation coefficient during unvoiced speech segments. By relating the coefficient to the estimated noise signal, an indication can be gained as to whether the speech segment is voiced for that segment.

Other aspects and advantages of the invention will become apparent from a consideration of the detailed description and drawings below.

DESCRIPTION OF THE PREFERRED EMBODIMENT

The speech analysis and synthesis system in which the present invention operates has for its basic purpose a reduction of data necessary to transmit speech electronically through a relatively limited bandwidth medium, such as a voice grade telephone line. The reduction is such that four separate speech channels may be transmitted through the single telephone channel which was originally designed for only one speech channel. The described analysis-synthesis process is sufficiently accurate that there is substantially no noticeable degradation in the quality of any of the four received speech channels.

The analysis-synthesis system operates on the known principle that a speech waveform, whether oral or its electrical analog, is dependent on the vocal cords and the associated physical vocal tract which creates it. Thus, the basic speech analysis-synthesis technique is to assume an analyzable vocal tract with a predetermined number of control parameters and to determine, substantially by mathematical analysis, what the value of those control parameters are for prescribed length of speech time or a "frame time". The control parameters may then be transmitted in abbreviated form to a synthesizer which is a mechanical or electrical analog of the vocal tract under the control of the selected parameters. The synthesizer substantially reproduces the original speech waveform. Before transmission, the parameters are subjected to data compression by a circuit which operates to examine each set of parameters, relating to each "frame time", and to eliminate redundancy or nonchanging information from frame to frame.

In the course of development of speech analysis-synthesis techniques, a number of analysis methods have been proposed in an attempt to derive numerical coefficients which most accurately describe the configuration of the vocal tract generating a particular speech waveform. Almost universally, modern analysis techniques are based on an analysis of the speech waveform over a prescribed period of time, or a "frame time", and the analytical parameters for that frame are generated as a unit and are usually transmitted to a receiver and applied to a synthesizer. Normally, the frame time is too short for changes to be audibly detected at the output of the synthesizer and, for some systems, including the system of the present invention, the data change from frame to frame is restricted to prevent abrupt changes from frame to frame which may be audibly detectable.

The speech analysis and synthesis system in which the present invention operates employs a linear prediction analysis method in which the representative parameters are pitch period, voiced/unvoiced decision, power and ten "K" coefficients descriptive of the analytical vocal tract which produced the speech. The speech signal to be analyzed is of voice grade telephone channel quality which is of considerably restricted band width, approximately 300–3000 Hz.

Figure 1:
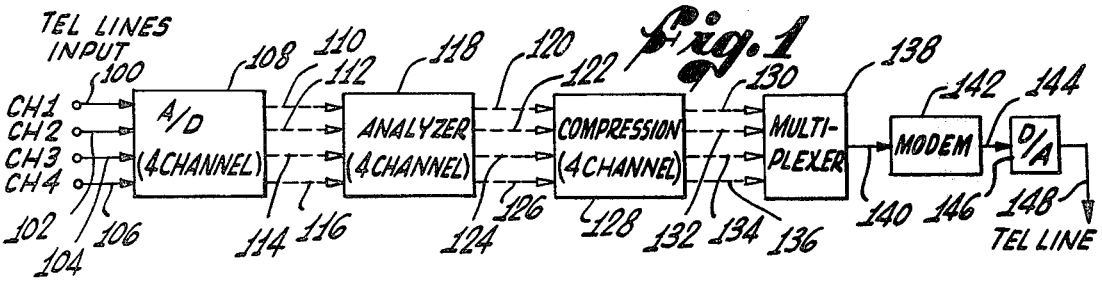
FIG. 1 is a block diagram of the analysis in which the present invention operates.
Figure 2:
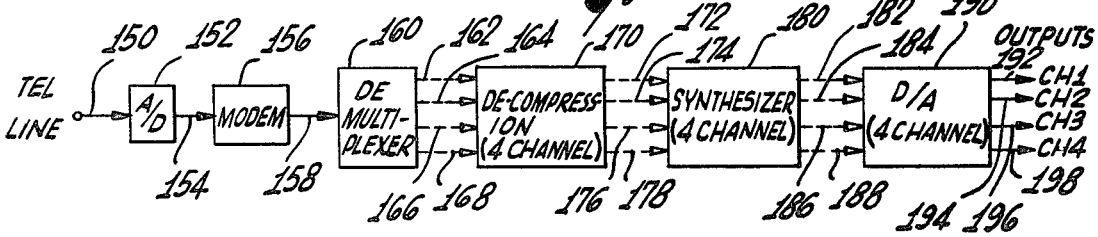
FIG. 2 is a block diagram of the synthesis section.

Turning now to the drawings, particularly FIGS. 1 and 2 thereof, the illustrative speech analysis and synthesis system receives input speech signals from four input channels on lines 100–106 which are typically voice grade telephone lines. As the analysis-synthesis process is performed digitally, an analog to digital converter 108 operating substantially in parallel, by rapid time multiplexed operations on each channel, converts the analog signals on the input lines 100–106 to corresponding digital channel signal information. The digital channel information is fed through lines 110–116 to an analyzer 118 which performs the analysis of the four channel information, again substantially in parallel. The analysis process will be discussed in detail below.

The analyzer 118 produces the parameters discussed above which are fed through lines 120–126 to a compression circuit 128 which essentially analyzes the frame data of each channel on a frame to frame basis to eliminate redundant or non-changing information from frame to frame. The compression process is also performed substantially in parallel for each of the channels and the particular techniques employed are disclosed in copending application Ser. No. 596,832, entitled DATA COMPRESSION SYSTEM.

The compressed data output is fed through lines 130–136 to a four channel multiplexer 138 which time-division multiplexes the compressed channel data into a single serial data stream on a line 140 which feeds a MODEM 142 which produces a digital signal pattern suitable for transmission through a conventional voice grade telephone line. The digital signal on an output line 144 is fed into a digital-to-analog converter 146 which converts the digital signal into an actual analog signal which is then fed over an output line 148 to a conventional voice grade telephone line.

It should be appreciated that while the data for each channel is processed substantially in parallel the analog-to-digital converter 108, the analyzer 118 and the compression circuits 128 process the data for each channel sequentially to reduce the necessary circuitry to a minimum. While each channel data is processed sequentially, the various steps in the processing are intermediately performed for each channel so that, in essence, all channels are processed substantially in parallel as the data moves through the analysis system.

At the receiver, the process is reversed to produce four analog signals for further transmission through voice grade telephone lines. Thus, as illustrated in FIG. 2, an input from a voice grade telephone line on an input line 150 is fed to an analog-to-digital converter 152 which digitizes the signal which is then fed through a line 154 to a digital Modem 156 which recovers the time-division multiplexed digital channel parameter data. The digital data is fed through a line 158 to a demultiplexer 160 which separates the digital channel parameter data into four separate channels on lines 162–168 connected to a decompression circuit 170 which analyzes the parameter data on all four channels substantially in parallel to generate complete sequential parameter data for each channel which is then fed through lines 172 through 178 to a synthesizer 180.

Figure 3:
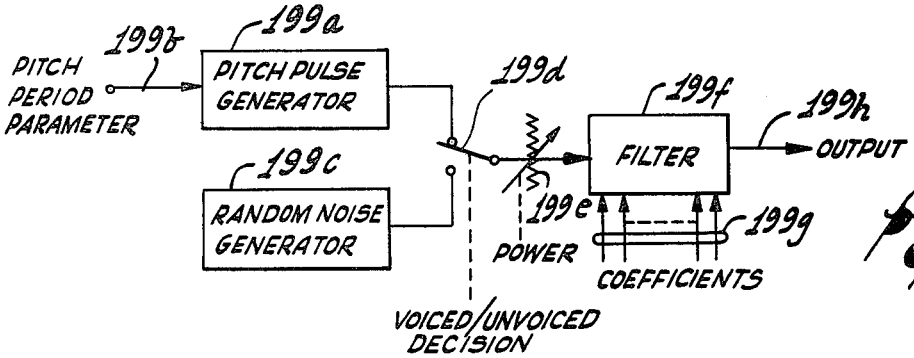
FIG. 3 is a block diagram of a basic speech synthesizer.

Conventionally, for a single channel, the synthesizer 180 would take the form shown in FIG. 3 in which a pitch pulse generator **199*a* generates pitch pulses in accordance with the received pitch period parameter on line 199*b*. A random noise generator 199*c* produces a noise signal for use with unvoiced speech signals. The outputs of the pitch pulse generator 199*a* and random noise generator 199*c* are connected to respective pole terminals of a single pole-double throw switch 199*d* which is under the control of the voiced/unvoiced decision parameter to connect the output of the pitch pulse generator 199*a* to the remainder of the circuit if the decision is voiced or connect the output of the random noise generator 199***d* to the circuitry of the decision is unvoiced.

The output of the switch 199*d* is connected through a gain control 199*e*, under the control of the power parameter, to the input of a filter 199*f* whose characteristics are under the control of the coefficients connected to the filter through the lines 199*g*. The output of the filter 199*f* is connected through line 199*h* to the remainder of the circuitry.

The synthesizer 180 of the present invention synthesizes the original human vocal tract from the channel parameters on the lines 172–178 substantially in parallel to produce digital representations of the speech signals on lines 182–188. The digitized speech signals on lines 182–188 are fed to a digital-to-analog converter 190 which converts the signals to analog form substantially in parallel and produces an output on lines 192–198 suitable for further transmission to four separate voice grade telephone lines connected to conventional telephone sets (not shown), for example.

Figure 3A:
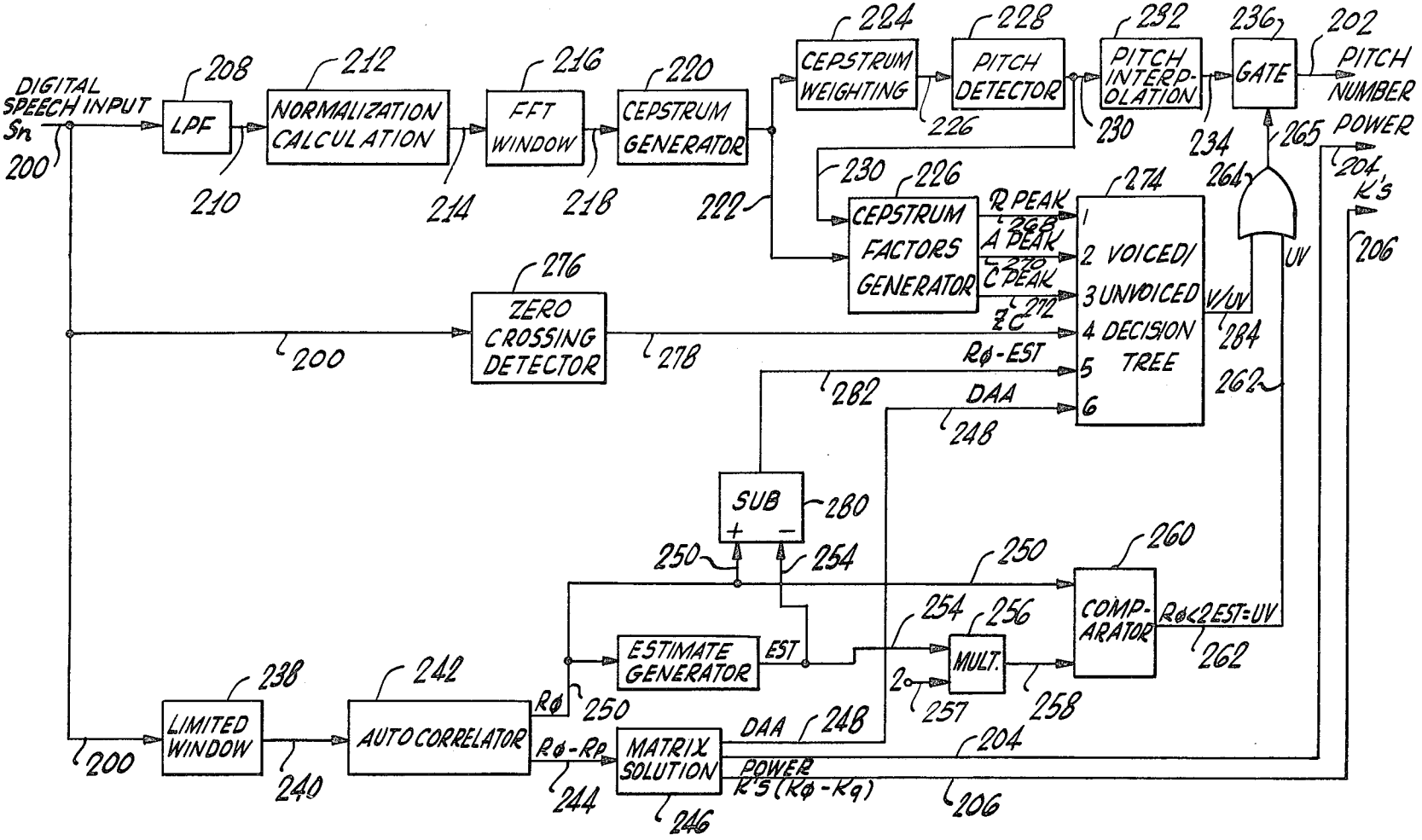
FIG. 3*a* is a block diagram of an analyzer for one channel of the analysis section shown in FIG. 1.

As discussed above the analyzer 118 shown in FIG. 1 processes the digital signal data from the four channels substantially in parallel. However, the analysis process for each channel may be considered separately and FIG. 3*a* is a hardware function block diagram of an analyzer for a single channel. It should be appreciated that each step of the analysis for the single channel is also performed substantially in parallel by utilizing appropriate buffers and other intermediate storage devices which are well known and conventional in the art.

Thus, for a single channel, the digital speech input on a line 200 is analyzed to produce the pitch period, power and coefficient (K's) parameters on lines 202, 204 and 206 respectively. In the illustrative system, the voiced/unvoiced decision parameter is represented by setting the pitch period parameter to zero. The analysis process is essentially three separate analysis steps. The first analysis step is to determine the pitch period of the digital speech input. The second analysis step is the determination of the coefficients (K's) of the analytical vocal tract which produced the digital speech input and the third analysis step is to determine whether the frame of digital speech input data is voiced or unvoiced which, as described above, determines whether a pitch frequency or random noise is applied to the filter 199*f* in the synthesizer shown in FIG. 3.

It should be appreciated that, while the digital speech input on line 200 is complete, each of the pitch period analysis and coefficient determination steps require only portions of that complete speech signal data. Therefore the speech signal data is modified as it proceeds through the various analysis steps.

In the first analysis technique, the determination of pitch period, the digital speech input is applied first to a conventional low pass filter 208 to eliminate extraneous high frequency components which are out of the analytical band. The low pass filter 208 is digital in nature and is conventionally constructed in accordance with well known techniques such as that discussed in "Digital Processing of Signals", Gold and Rader, McGraw-Hill, 1969 to produce alternate samples at its output on line 210.

The output of the low pass filter on line 210 is connected to a normalization calculation circuit 212 in order to normalize the amplitudes of the samples of digital speech data to a particular value upon which the further analysis is based. The normalized digital speech data on output line 214 is connected to a Fast Fourier Transform (FFT) window 216. The particular class of window is utilized because the Cesptrum calculation is a Fast Fourier Transform process and the FFT window 216 ensures maximum effectiveness of the Cepstrum calculation. The window data on line 218 is connected to a conventional Cepstrum generator 220 which performs the Cepstrum calculations, as discussed above.

While the Cepstrum calculation uses conventional sequential processing techniques, an important feature of the illustrative system is that only alternate samples of the digital speech data are used in the Cepstrum calculation in order to decrease the processing time necessary to generate the Cepstrum. It has been found that any degradation in the generation of the Cepstrum is minimal and the accuracy of the subsequent pitch determination from the Cepstrum can be partially restored in a novel pitch interpolation technique which is described in detail below.

The Cepstrum data on output line 222 is utilized not only in the determination of pitch but in the later determination of the voiced/unvoiced decision, as discussed below. When the Cepstrum data is utilized in determining the pitch number, the Cepstrum data is connected to a Cepstrum weighting section 224, described in detail below, which modifies the Cepstrum waveform in order to enhance the detection of the Cepstrum peak values needed to determine pitch. The weighted Cepstrum on output line 226 is connected to a pitch detector 228 which scans the weighted Cepstrum for peak values and checks the original peak determination for the "double pitch" phenomenon described in the literature. See Noll, "Cepstrum Pitch Determination", The Journal of the Acoustical Society of America, Vol. 44, No. 2, 1967, p. 293.

The pitch or pitch number generated by the pitch detector 228 is then connected through a line 230 to a pitch interpolation section 232 which examines the pitch data and surrounding Cepstrum data to interpolate between sample values in the vicinity of the detected pitch period and, by a mathematical interpolation technique, generates a more accurate peak value and pitch period. Thus, the pitch interpolation section 232 partially restores the accuracy of the pitch period even though only alternate Cepstrum data samples were utilized, as discussed above.

The interpolated pitch period value on output line 234 is connected through a gate 236 to the output line 202 for the pitch period. When the voiced/unvoiced decision is voiced, the interpolated pitch period value on line 234 designated the pitch period on line 202. However, regardless of the calculated pitch period value on line 234, if the voiced/unvoiced decision is unvoiced, the pitch period on output line 202 is set to zero to indicate the unvoiced condition. Thus, the voiced/unvoiced decision determines whether the calculated pitch period value is to be utilized or not. It should be appreciated that the pitch determining calculation may result in the generation of a pitch number despite the fact that the other parameters of the digital speech data on line 200 indicate that the data represents unvoiced speech. Thus, the full analysis of the digital speech input determines the voiced/unvoiced decision and, if it is voiced the output of the pitch interpolation section 232 is deemed to be correct pitch period value.

In the determination of the coefficients or K's the digital speech data on line 200 is subjected to a different analysis process. Thus, the data on line 200 is connected first to a novel limited window 238 which conditions the data for the calculation of the coefficients. The limited window 238 takes advantage of the empirically determined fact that, for the coefficient calculations, the digital speech data located at either end of the window can be effectively deleted, limiting the number of samples of the digital speech data needed for the calculations. Thus, as will be further discussed below, the limited window 238 provides a properly windowed abbreviated frame of data for the coefficient calculations. The truncated and windowed digital data on line 240 is then subjected to a conventional and well known linear prediction analysis and, therefore, is connected to a conventional autocorrelator 242 which generates intermediate autocorrelation coefficients on output line 244 further connected to a matrix solution section 246 which generates the K coefficients on line 206, a power term on line 204 and an error term (DAA) on a line 248 which is subsequently used in the voiced/unvoiced decision, as will be discussed below.

The autocorrelator 242 and matrix solution section 246 are constructed in accordance with conventional design techniques for a linear prediction solution such as discussed in Makhoulaad Wolf, "Linear Prediction and the Spectral Analysis of Speech", NTIS, AD-749066, Bolt, Beranek and Neuman, Inc., Cambridge, Mass., RBN Rep. 2304, August 1972. See also U.S. Pat. Nos. 3,624,302 and 3,631,520. The error term DAA is a conventional output of the least mean squares analysis of the matrix solution and is well known though it may not be utilized in systems of the prior art.

The third analysis technique is making the voiced/unvoiced decision. In making the voiced/unvoiced decision, a plurality of factors are examined in a particular order of priority and, a superior factor decision is deemed determinative of the voiced/unvoiced decision. However, the examination of a factor may not result in a decision in which case the following factor is examined. Thus, if a particular factor determines that the digital speech input is representative of unvoiced speech, the remaining inferior factors are not considered. But, each of the factors are variable, and a voiced-/unvoiced decision is dependent upon the factor falling outside of an "ambiguous range". If the factor value is within the ambiguous range the other factors are sequentially examined to determine whether or not they also fall within their individual ambiguous ranges. Normally, for any given frame of digital speech input data, the voiced/unvoiced decision can be made. But when all the factors are within their ambiguous ranges, the decision is to use the pitch number generated on line 234 as that appears to be the best use of all the analytical data.

Considering the factors examined in making the voiced/unvoiced decision, of primary concern is whether the overall signal represented by the digital speech data is sufficiently "organized" so as to have resulted from definite pitch pulses generated by the volcal cords. In the system of the invention, this organization is determined by comparing a parameter which is dependent upon organization of the signal with the average noise contained by the signal. If the dependent parameter is not sufficiently greater than the average noise level, the decision is immediately made that the digital speech data on line 200 must be unvoiced.

However, while the dependent parameter may be found in the analysis process, the average noise level in the signal is indeterminable. Therefore, in the system of the invention illustrated in FIG. 3, the dependent parameter which is used is the first autocorrelation coefficient ($R_\phi$) generated by the autocorrelator 242. The average estimated noise in the digital speech data is produced by an estimate generator 252. The average noise signal "EST" produced by the estimate generator on line 254 is compared with the first autocorrelation coefficient $R_\phi$ to determine whether the unvoiced decision may be made immediately. The operation of the estimate generator 252, which is central to the present invention, is described in detail below.

In the analysis system described herein, it has been empirically determined that, unless the first autocorrelation coefficient $R_\phi$ is at least twice the estimated noise EST, it is most likely that the digital speech data is unvoiced. Therefore, the estimated noise signal EST on line 254 is multiplied by the constant 2 on line 257 by multiplier 256 and the doubled estimate signal on line 258 is compared with the first autocorrelation coefficient signal $R_\phi$ on line 250 by means of a comparator 260. The comparator 260 produces an output which is an unvoiced decision if $R_\phi$ is less then twice the estimated noise signal. The output on line 262 is connected to one input of an OR gate 264 the output of which on line 265 controls the gate 236 which either passes the interpolated pitch number on line 234 to the pitch number output line 202 or sets the pitch number on line 202 to zero if the unvoiced decision is made.

However, the fact that the first autocorrelation coefficient $R_\phi$ is greater than twice the estimated noise level is not determinative that the digital speech data is voiced. A further, more analytical decision is then made by examining the plurality of factors described above. The most important factors to be examined are those derived from an examination of the Cepstrum signal on line 222 as well as the detected pitch on line 230. Both signals are connected to the input of a Cepstrum factors generator 266 which produces three auxilliary signals which will be discussed in detail below. The "R peak", "A peak", and "C peak" signals on lines 268, 270 and 272, respectively, result from an examination of the sharpness of the peak of the Cepstrum and the further information contained in the Cepstrum waveform. The signals on lines 268, 270 and 272 are connected as inputs in a prescribed priority to a voiced/unvoiced decision tree 274. As will be described below, the voiced/unvoiced decision tree 274 essentially examines the signals on the lines 268–272 to determine whether they fall within accepted ranges. If any of the signals fall outside of a particular range, the decision is made that the digital speech data is voiced or unvoiced. If a particular factor signal falls within the prescribed range, the decision is indeterminate and the next factor signal is examined.

If it cannot be determined from the Cepstrum factors whether the digital speech data is voiced or unvoiced, the digital speech data on line 200 is examined by means of a zero-crossing detector 276 to determine how many times the signal crosses the zero axis. The number of zero-crossings as an output on line 278 is applied to the voiced/unvoiced decision tree 274 and, again, if the number of zero-crossings falls within a prescribed range, the voiced/unvoiced decision can be made. However, if not, a more direct comparison of the first autocorrelation coefficient $R_\phi$ and the estimated noise EST is made by means of direct subtraction in a subtractor 280 which produces a signal "$R_\phi$-EST" on a line 282 connected to the voiced/unvoiced decision tree 274.

Again, if the decision is still indeterminate, an error signal DAA on line 248 from the matrix solution block 246 is examined to determine how random the digital speech input signal is. As noted above, the matrix solution 246 is essentially a least mean squares approximation and, if the approximation is reasonably close to a periodic signal, the error signal DAA will be low indicating a voiced decision however, if the digital speech data is substantially random, the error signal DAA on line 248 will be relatively high, indicating an unvoiced condition.

The voiced/unvoiced decision tree 274 produces an output on a line 284 only for an unvoiced decision which is connected as a second input to OR gate 264 which again, through output line 265 controls the gate 236. If a voiced decision from the voiced/unvoiced decision tree 274 is made, the output line 284 is automatically set to a no output condition. Thus, the unvoiced condition is indicated by an output on line 262 or 284.

So that the importance of a reliable technique for the estimation of system noise may be better appreciated, the analysis process as it relates to the voiced/unvoiced decision-making process will be described in detail before turning to a description of the noise estimation system itself. Other detailed aspects of the analysis/synthesis system are described in the aforementioned U.S. Pat. No. 4,015,088.

As discussed above, while the analysis process may produce a pitch period, the nature of the digital speech data may be such that an overall analysis indicates that an unvoiced determination may be more correct. Thus, as discussed above, in ambiguous cases a plurality of auxilliary factors are examined in a predetermined sequence with a predetermined priority. The more important of these factors are derived from a further analysis of the Cepstrum waveform, in particular, how well defined that peak is in relation to the signal waveform on either side of it.

For the presently preferred embodiment, a typical Cepstrum peak is assumed to occupy approximately six sample positions. The signal waveform for a short distance on either side of the assumed peak range is therefore examined to determine information, or power, content and the characteristics of the peak within those ranges. The information content is determined by summing the absolute values of the samples within the two auxilliary ranges and the total divided by the Cepstrum peak to obtain a numerical value (A peak) related to relative information content.

To determine the relative amplitude of any peaks within the auxilliary ranges, a peak detector selects the sample with the maximum amplitude within the auxilliary ranges and again, that value is divided by the Cepstrum peak value to develop a relative range peak (R peak) signal.

The average information content signal, A peak, varies from a value of zero to a value of one with a larger number indicating a voiced decision. This is because the absolute values are added and a larger number indicates a significant amount of excursions above and below the zero axis of the Cepstrum before and after the chosen Cepstrum peak which is indicative of a clearly defined Cepstrum peak. The range peak signal will vary from a zero value to a maximum of one with the larger the number being indicative of an unvoiced signal due to the fact that there is an auxilliary peak near the chosen pitch peak value which is of relatively high amplitude indicating that the chosen pitch peak is not clearly defined.

Figure 4:
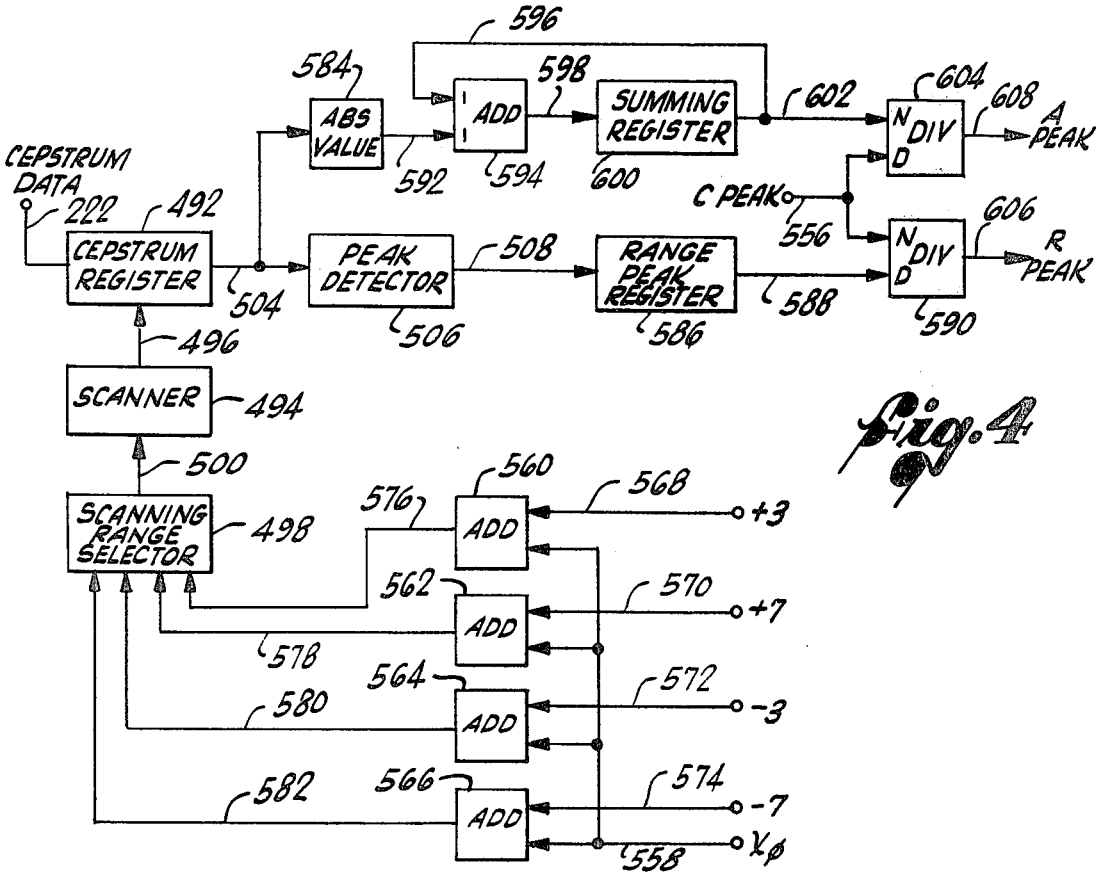
FIG. 4 is a hardware function block diagram of the Cepstrum factors generator section of the analyzer of FIG. 3*a;*

The two auxilliary signals A peak and R peak are derived by means of the hardware function block diagram illustrated in FIG. 4. Again, the Cepstrum register 492, scanner 494 and scanning range selector 498 are employed and the Cepstrum data (un-weighted) on line 222 is entered into the register 492. From the previously discussed peak detector 228, the pitch period $X_\phi$ on line 558 is entered as a first input to four adders 560, 562, 564 and 566. Constants of +3, +7, --3 and −7 are connected through lines 568, 570, 572 and 574 respectively to adders 560, 562, 564 and 566. The range select outputs on lines 576, 578, 580 and 582, respectively, are connected as inputs to the scanning range selector 498 which, by controlling the scanner 494, samples the Cepstrum within two ranges on either side of the previously selected pitch period. The output of the scanned Cepstrum register 492 on line 504 is connected to an absolute value circuit 584 and also to the peak detector 506. The output of peak detector 506 on line 508 is connected to range peak register 586 and, following the scan, the peak value in range peak register is connected through a line 588 to the denominator input of a divider 590.

The absolute value of each Cepstrum sample within the auxilliary ranges is connected through a line 592 to one input of an adder 594. The second input to adder 594 on line 596 is the sum of the absolute values of the previous samples. The previous sum plus each new absolute value are added and connected through a line 598 to a summing register 600 in which the total sum is eventually formed. The total sum of the absolute values of the samples is connected through a line 602 to the numerator input of a divider 604. The Cepstrum peak signal (C peak) on line 556 is connected to the numerator and denominator inputs of dividers 590 and 604, respectively, and the quotients form the R peak and A peak signals on lines 606 and 608 respectively.

Figure 5:
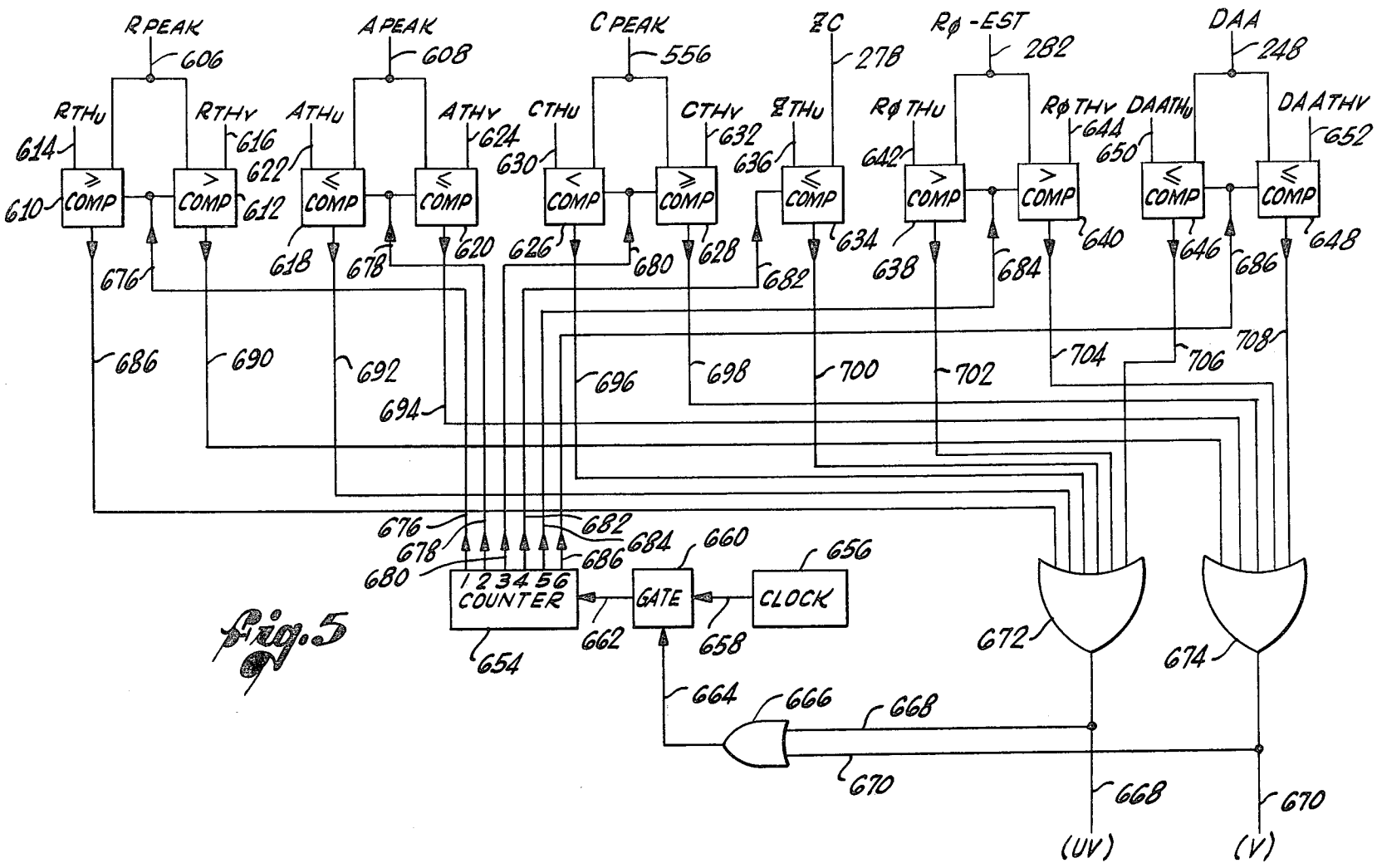
FIG. 5 is a hardware function block diagram of the voiced/unvoiced decision section of the analyzer of FIG. 3*a;*

When the auxilliary signals from the pitch detector 228, the Cepstrum factors generator 266, the first autocorrelation coefficient on line 250 as well as the estimate signal (EST) on line 254 and the error signal DAA on line 248 are available, the voiced/unvoiced decision tree 274 (FIGS. 3*a* and 5) may be used to determine whether the digital speech data is voiced or unvoiced in ambiguous cases. Typically the Cesptrum peak will be so much greater than the range peak (R peak) signal that the decision may be made quickly for voiced speech data. However, for whispered or unusual inflections in speech, the voiced/unvoiced decision may not be as readily made. Therefore, the auxilliary factors are connected to a voiced/unvoiced decision tree 274, the implementation of which is illustrated in the hardware function block diagram of FIG. 5.

In this implementation, the R peak signal on line 606, the A peak signal on line 608, the C peak signal on line 556, the zero crossing signal on line 278, the $R_\phi$-EST signal on line 282 and the DAA error signal on line 248 serve as inputs to a plurality of comparators which, together with appropriate comparing threshold signals, define ranges for those signals which produce either a voiced, an unvoiced or an undecided decision. Each input signal is sequentially examined in a predetermined priority with three possible outputs for each input signal.

Thus, the R peak signal on line 606 is connected to first inputs of a pair of comparators 610 and 612 which have as second inputs constants set at predetermined unvoiced and voiced thresholds on lines 614 and 616, respectively. Similarly, the A peak signal on line 608 is connected to first inputs of another pair of comparators 618 and 620 which have as second inputs threshold constants for unvoiced and voiced thresholds on lines 622 and 624, respectively. The C peak signal on line 556 is connected as first inputs to two comparators 626 and 628 which have as their second inputs unvoiced and voiced constants connected to second inputs on lines 630 and 632, respectively. The zero-crossing number on line 278 is connected as the first input to a single comparator 634 which has a second input a unvoiced threshold constant on line 636. The $R_\phi$-EST signal on line 282 is connected as first inputs to a pair of comparators 638 and 640 which have as their second inputs unvoiced and voiced threshold constants on lines 642 and 644, respectively. The error signal DAA on line 248 is connected as first inputs to a pair of comparators 646 and 648 which have as their second inputs unvoiced and voiced thresholds constants on lines 650 and 652, respectively.

The comparator networks for the input signals are activated by means of enabling signals sequentially generated by a counter 654 which is driven by a clock 656 which supplies clock pulses through a line 658 to a gate 660 which, if enabled, permits the pulses to enter the counter through a line 662. The gate 660 is controlled through a line 664 from the output of an OR gate 666. The input line 668 and 670 to the OR gate 666 are derived from the outputs of multiple input voiced or unvoiced OR gates 672 and 674. The gate 660 permits clock pulses to enter the counter 654 which will produce enabling signals for the comparators only if a particular comparison results in an indeterminate decision. If a voiced or unvoiced decision is made at any comparison, the decision on lines 668 or 670, respectively, disables the gate 660, preventing further comparisons.

The counter produces sequential enabling outputs on 6 different lines 676, 678, 680, 682, 684, and 686. The enabling signals on the lines 676–686 are connected to enabling inputs of the various comparator combinations, with the output lines of the comparators being connected to alternate inputs of the voiced or unvoiced OR gates 672 and 674. Thus, the R peak comparators 610 and 612 have unvoiced and voiced decision outputs 688 and 690, respectively, the A peak signal comparator 618 and 620 have unvoiced and voiced decision outputs 692 and 694, respectively, the Cepstrum peak signal comparators 626 and 628 have unvoiced and voiced decision outputs on line 696 and 698, respectively, the zero-crossing signal comparator 634 has an unvoiced decision output line 700, the $R_\phi$-EST signal comparators 638 and 640 have unvoiced and voiced decision output lines 702 and 704, respectively, and the error DAA input comparators 646 and 648 have unvoiced and voiced decision lines 706 and 708, respectively. The unvoiced decision lines are all connected to the unvoiced OR gate 672 while the voiced decision lines are connected as inputs to the voiced OR gate 674.

As discussed above with reference to the voiced/unvoiced decision, a criteria in determining whether a speech data signal should be represented as voiced or unvoiced speech is whether the energy of the signal is above a certain noise level. While the total energy of the signal is generally accepted to be adequately represented by the magnitude of the first autocorrelation coefficient $R_\phi$, the average noise level of the speech data signal is difficult to evaluate by measurement.

Thus, it is a feature of the system of the present invention to estimate the average noise level so that a comparison of the autocorrelation coefficient $R_\phi$ can be made for the voiced/unvoiced decisions discussed above. The noise estimation technique is partially based upon the fact that the autocorrelation coefficient $R_\phi$ varies relatively regularly because there are clearly defined intervals of voiced speech followed by unvoiced speech. During the unvoiced periods, the $R_\phi$ term is normally quite low and used to establish a base level for the estimated noise level in the particular channel for that time. When a voiced interval returns, the $R_\phi$ term will normally be well above the noise level, which is hereinafter called the estimated noise signal (EST).

Figure 6:
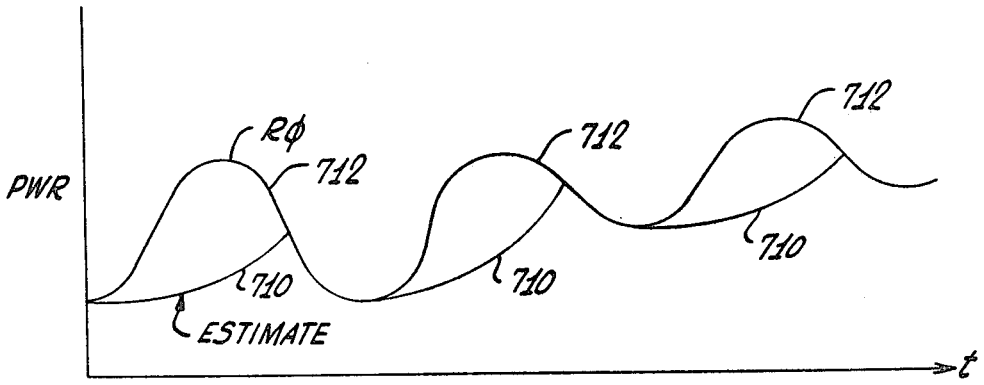
FIG. 6 is a signal diagram of the variation of the power term ($R_\phi$) and its relationship into the generated estimated noise term (EST)

While it is assumed that during unvoiced segments of speech, the noise level cannot be greater than the coefficient $R_\phi$, it is also assumed that the noise level will gradually increase during voiced speech segments. Therefore, as illustrated in FIG. 6, the estimated noise signal 710 can never be greater than the $R_\phi$ coefficient 712 but the $R_\phi$ coefficient can increase at a much greater rate than is permitted for the estimate signal (EST) 710. Therefore, as the $R_\phi$ term decreases toward an unvoiced speech segment, the noise estimate signal (EST) 710 will maintain the same value as the $R_\phi$ coefficient. However, as the $R_\phi$ coefficient increases during a voiced speech segment, the estimate signal is permitted to increase only at a slow exponential rate. However, from a consideration of FIG. 6, it can be seen that as the actual average noise level increases, the $R_\phi$ term increases during unvoiced speech segments and the base starting level for the estimate noise signal (EST) 710 gradually can increase.

Figure 7:
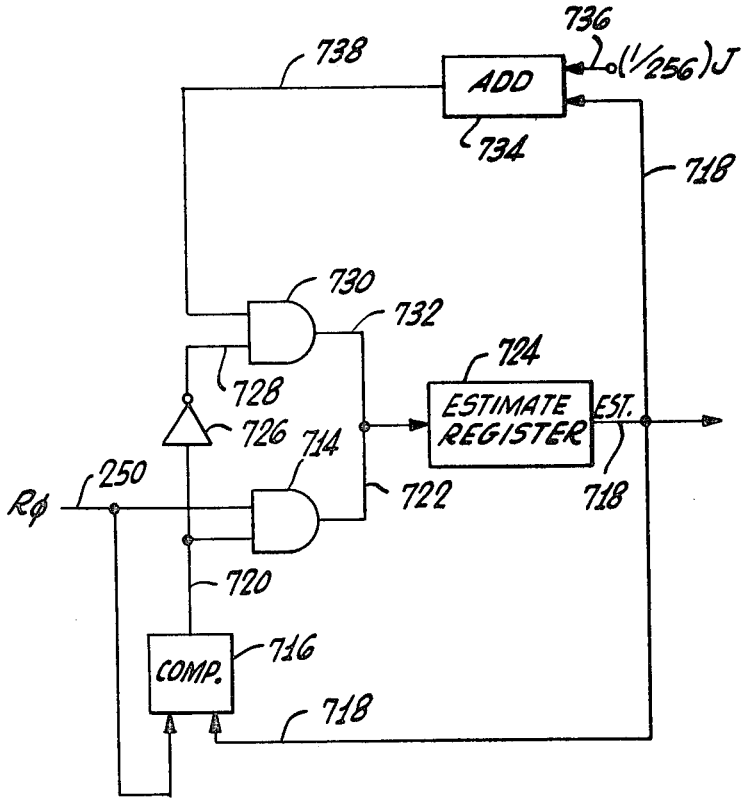
FIG. 7 is a hardware function block diagram of the estimate generator section of the analyzer of FIG. 3 with a companion test for an initial voiced/unvoiced decision.

A functional hardware block diagram of the estimate generator 252 shown in FIG. 3*a* is illustrated in FIG. 7. The first autocorrelation coefficient $R_\phi$ on line 250 is connected both as an input to a first AND gate 714 and as a first input to a comparator 716. A second input to the comparator 716 on a line 718 is the present estimate signal EST which is compared with the $R_\phi$ coefficient. If the $R_\phi$ coefficient is less than the estimate signal on line 17, the comparator generates an output on a line 720 which enables the AND gate 714 to connect the $R_\phi$ coefficient on line 250 through an output line 722 to the input to an estimate register 724. The enabling signal from the comparator 716 on line 720 is also connected through an inverter 726 which generates a disabling signal on a line 728 for an AND gate 730 which has an output on a line 732, also connected as an input to the estimate register 724.

The AND gate 730 connects the present output of the estimate register on line 718 as a first input to an adder 734 which adds a constant J (1/256) on a second input 736 to the adder to produce an output on a line 738 which serves as the signal input to the AND gate 730. Thus, assuming conventional clocking techniques, the constant J (1/256) is sequentially added to the signal in the estimate register for each clock time if the $R_\phi$ term is equal to or greater than the present output of the estimate register 724 on line 718. If the $R_\phi$ coefficient on line 250 should become less than the present output of the estimate register 724 on line 718, the sequential addition is disabled and the present value of the $R_\phi$ coefficient is inserted into the estimate register. Therefore, the output of the estimate register on the line 718 will be the $R_\phi$ coefficient until the $R_\phi$ coefficient begins to increase again. Depending upon the value of the constant J, which in this case is (1/256), the present output of the estimate can be made to attempt to follow the $R_\phi$ coefficient at any desired rate.

While the presently preferred embodiments for the features of the present invention have been described conceptually by way of drawings, in the actual presently preferred physical embodiment, the system of the invention is controlled and operated by means of fixed instruction sets stored in read-only memories (ROMS). It should be appreciated that the features of the invention may be practiced by a plurality of different techniques depending upon the state of the art and the particular hardware devices available. Therefore, the invention is not to be limited except by the following claims.

We claim:

1. A noise level estimation system for use with a speech analysis system which derives coefficient parameters by linear prediction, utilizing an intermediate auto-correlation technique which produces a set of auto-correlation coefficients designated $R_\phi$ through $R_p$, wherein $R_\phi$ is the first auto-correlation coefficient, said noise estimation system comprising:

estimate register means;

means for comparing the contents of said estimate register means with said first auto-correlation coefficient and setting said estimate register means to the value of said first auto-correlation coefficient if the value of said first auto-correlation coefficient is equal to or less than the contents of said estimate register means; and means for incrementing the contents of said estimate register means if said first auto-correlation coefficient is greater than the contents of said estimate register means.

2. A method of noise level estimation for use with a speech analysis system which derives coefficient parameters by linear prediction, utilizing an intermediate auto-correlation technique which produces a set of auto-correlation coefficients designated $R_\phi$ through $R_p$, wherein $R_\phi$ is the first auto-correlation coefficient, said noise estimation method comprising the steps of:

comparing the contents of an estimate register with the first auto-correlation coefficient;

setting the estimate register to the value of the first auto-correlation coefficient, if the coefficient value is equal to or less than the contents of the estimate register;

incrementing the contents of the estimate register if the value of the first auto-correlation coefficient is greater than the contents of the estimate register.

3. A system as set forth in claim 1, wherein said means for incrementing the contents of said estimate register means operates to add an incremental value to said register means each time said means for comparing determines that the said first auto-correlation coefficient is greater than the contents of said estimate register means, whereby the contents of said estimate register means increases at a predetermined rate until it reaches said first auto-correlation coefficient.

* * * * *